United States Patent [19]

Kramer et al.

[11] Patent Number: 4,505,339

[45] Date of Patent: Mar. 19, 1985

[54] HYDRAULIC CONTROL FOR A DOZER BLADE

[75] Inventors: Lee F. Kramer, Waukegan; Ronald K. Schantz, Libertyville; Steven C. Kirkham, McHenry; Charles M. Tschanz, Lindenhurst, all of Ill.

[73] Assignee: Dresser Industries, Inc., Dallas, Tex.

[21] Appl. No.: 388,569

[22] Filed: Jun. 14, 1982

Related U.S. Application Data

[63] Continuation of Ser. No. 125,397, Feb. 27, 1980, abandoned.

[51] Int. Cl.[3] ..... E02F 3/76; F16B 11/00

[52] U.S. Cl. ..... 172/812; 91/420; 91/515; 172/826

[58] Field of Search ..... 91/420, 436, 512, 514, 91/515, 517, 526, 531

[56] References Cited

U.S. PATENT DOCUMENTS

| | | | |
|---|---|---|---|
| 2,460,774 | 2/1949 | Trautman | 91/515 |
| 3,033,219 | 5/1962 | Erle | 91/515 |
| 3,199,539 | 8/1965 | Leathem | 91/515 |
| 3,455,320 | 7/1969 | Garman | 91/515 |
| 3,481,489 | 12/1969 | Stauffer | 91/515 |
| 3,850,081 | 11/1974 | Joelson | 91/515 |
| 3,961,670 | 6/1976 | Rivinius | 91/171 |
| 3,966,066 | 6/1976 | Schexnayder | 91/531 |
| 3,990,583 | 11/1976 | Nishida | 91/420 |
| 4,037,671 | 7/1977 | Kimber | 91/420 |
| 4,083,291 | 4/1978 | Larsson | 91/517 |
| 4,166,506 | 9/1979 | Tezuka | 91/512 |
| 4,194,436 | 3/1980 | Imada | 91/436 |
| 4,237,688 | 12/1980 | Demmers | 91/512 |
| 4,286,432 | 9/1981 | Burrows | 91/420 |

*Primary Examiner*—Abraham Hershkovitz
*Attorney, Agent, or Firm*—Barry E. Deutsch

[57] ABSTRACT

A hydraulic circuit for pitch and tilt control of a dozer blade attached to push arms on a vehicle with a pitch ram connected between one push arm and the blade and a dual actuator consisting of a second pitch ram and a tilt ram connected at their head ends. A pitch valve directs hydraulic fluid to and from the pitch rams with a diverter/combiner valve interposed therebetween to assure a flow of fluid either to said rams or from said rams at equal rates. Pilot-operated check valves hydraulically lock the pitch rams until opened by pressure directed from said pitch valve. Tilt and lift valves directs fluid pressure to and from the tilt ram and a lift ram respectively with regeneration capability for both tilt and lift functions.

4 Claims, 2 Drawing Figures

HYDRAULIC CONTROL FOR A DOZER BLADE

CROSS REFERENCE TO RELATED APPLICATIONS

This is a continuation of application Ser. No. 06/125,397, filed Feb. 27, 1980, now abandoned.

This application is related to the subject matter in co-pending U.S. patent applications Ser. No. 124,875 now U.S. Pat. No. 4,352,398, filed by R. K. Schantz and entitled CONTROL FOR PITCH AND TILT OF DOZER BLADE, and Ser. No. 125,398 now abandoned and a continuation filed Dec. 10, 1982, U.S. Ser. No. 448,170, filed by S. C. Kirkham, R. K. Schantz and L. F. Kramer and entitled HYDRAULIC CONTROL FOR PITCH AND TILT OF DOZER BLADE. All three applications were filed on the same day and are assigned to a common assignee.

BACKGROUND AND SUMMARY OF THE INVENTION

It has long been recognized that a pair of pitch rams, one ram connected between each of the two push rams physically connecting the dozer blade to the vehicle, will provide pitch capability. However, the two pitch rams must be extended and retracted in unison, i.e. at the same rate, in order to preclude the introduction of unintended tilting. Similarly, it has been recognized that the elongation and shortening of only one actuator connected between one push arm and the blade will effect a raising and lowering of the adjacent corner of the blade. However, an arrangement that maintains the desired independence between pitch and tilt and which provides precise and accurate pitching has been a problem.

It is, therefore, an object of this invention to provide a means for pitch and tilt control of a dozer blade which permits precise and accurate movement, which is unaffected by the application of external forces on the blade, which is relatively simple and economical to construct and maintain, and which is useable in virtually any material or under a wide variety of soil conditions while at all times maintaining the same operational and response characteristics.

These and other objects of the present invention, and many of the attendant advantages thereof, will become more readily apparent from a perusal of the following description and the accompanying drawings, wherein.

DESCRIPTION OF A PREFERRED EMBODIMENT

Figure 2:
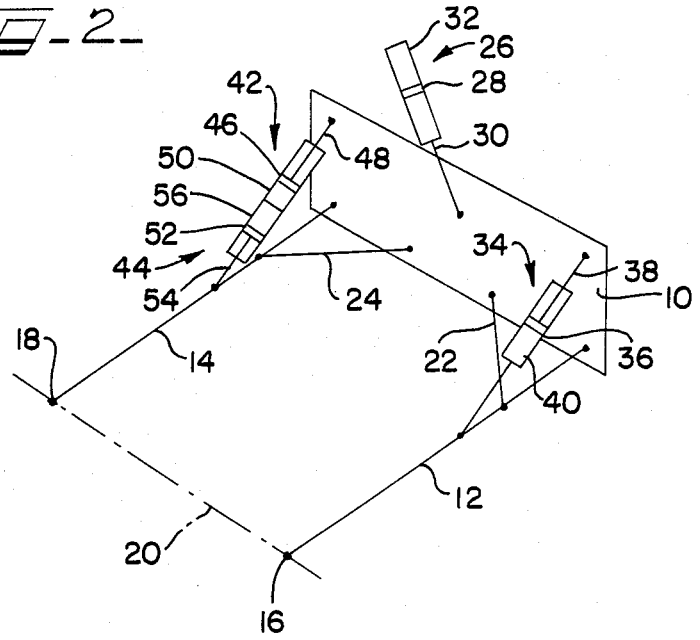
FIG. 2 is a schematic representation of a dozer blade arrangement incorporating the present invention.

Referring first to the arrangement of FIG. 2, there is shown a dozer blade 10 pivotally connected to push arms 12 and 14, which are pivotally connected to a vehicle at 16 and 18 and define an axis 20 about which the arms 12 and 14 rotate to raise and lower the blade 10. A pair of diagonal struts or braces 22 and 24 connect between the blade and the push arms to provide lateral stability to the blade 10. A lift ram 26, including a piston 28 with affixed 30 reciprocable within a cylinder 32, is connected between the blade and the vehicle, and effects rotation of the push arms 12 and 14 about the axis 20 to raise and lower the blade 10. The above description is of a generally conventional dozer blade mounting.

A pitch ram 34, including a piston 36 with affixed rod 38 reciprocable within a cylinder 40 is connected between the push arm 12 and the blade 10. A dual actuator consisting of a pitch ram 42 and a tilt ram 44 connected at their head ends is connected between the push arm 14 and the blade 10. The pitch ram 42 includes a piston 46 with affixed rod 48 reciprocable within a cylinder 50, while the tilt ram 44 includes a piston 52 with affixed rod 54 reciprocable within a cylinder 56.

Figure 1:
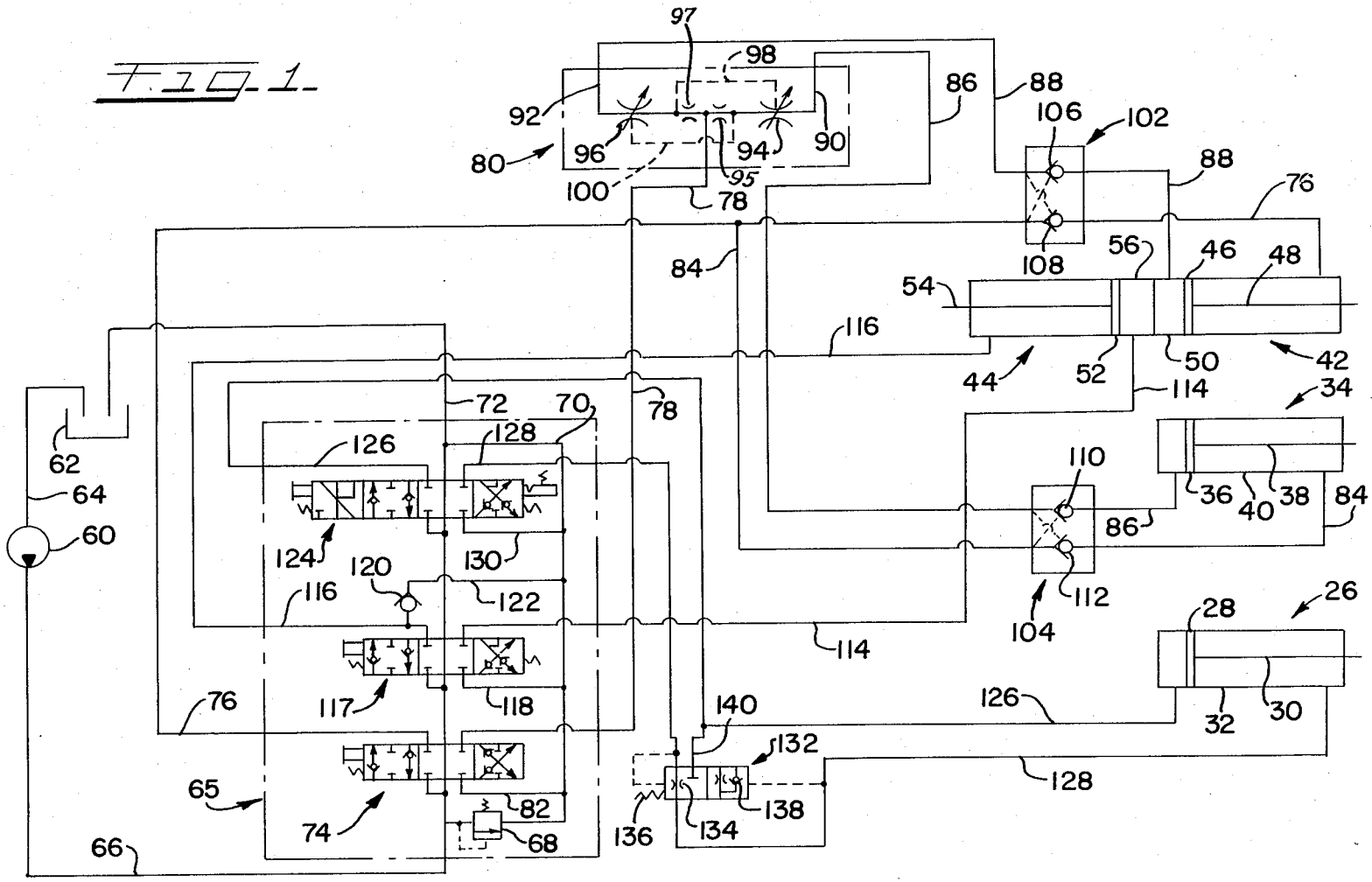
FIG. 1 is a hydraulic schematic of a preferred embodiment of the invention.

Referring now to the hydraulic circuit shown in FIG. 1, a pump 60 draws hydraulic fluid from a reservoir 62 through suction line 64 and discharges fluid under pressure to a valve block, indicated generally at 65, through supply conduit 66. A pressure relief valve 68 in a bypass conduit 70, connected between supply conduit 66 and return conduit 72 leading to the reservoir 62, limits the maximum pressure in the circuit. A pitch valve 74 has a pair of conduits 76 and 78; the former leading to the rod end of pitch ram 42 and the latter to a diverter/combiner valve 80. When the valve 74, which is of the open-center, three position type, is shifted to the right, conduit 76 is connected with the supply conduit 66 and conduit 78 is connected with reservoir 62 by means of conduits 82, 70 and 72. Flow of fluid under pressure will be directed to the rod end of pitch ram 42 and to the rod end of pitch ram 34 by means of branch conduit 84. Both rams 34 and 42 will be contracted forcing fluid from their head ends into conduits 86 and 88 respectively. The conduits 86 and 88 connect with passages 90 and 92 in valve 80. The diverter/combiner valve, which is pressure and flow compensating and may be of the type sold by Husco Division of Koehring Company as Part No. 9030-1, includes a pair of variable orifices 94 and 96 and a pair of fixed orifices 95 and 97 located respectively in passages 90 and 92. The orifices 94 and 96 are variable as a function of pressure communicated by sensing passages 98 and 100. The flow in each of the conduits 86 and 88 is combined and returned to reservoir 62 through conduits 78, 82, 70 and 72.

If the sum of the external forces acting on the pitch rams results in one ram executing its collapse with less resistence, or even assistance, the rate of fluid flow from the head end of that ram will tend to be greater. The higher flows will result in a greater pressure drop and hence a lower pressure in the sensing passage communicating with the higher flow rate. The lower flow rate in the other passage will result in less of a pressure drop and hence a higher pressure in the sensing passage associated therewith. The higher pressure in this sensing passage will restrict the variable orifice in the passage with the higher flow. The flow rates through each will thus be equal and the rams 34 and 42 will contract in unison. The desired pitch angle is thereby achieved without the introduction of undesired and unintended tilt of the blade 10.

Shifting the valve 74 to the left, connects conduit 78 with supply conduit 66 and connects conduit 76 with reservoir 62. The rams 34 and 42 will receive fluid pressure at their head ends and will extend, forcing fluid from their rod ends for return to reservoir. The flow to the head ends is through the valve 80, which will function in a manner similar to that described above to assure an equal distribution of fluid between the conduits 86 and 88, regardless of pump output or resistance encountered. For example, if ram 34 has a greater resistance to its movement than ram 34, the flow through conduit 88 will increase relative to the flow in conduit 86, resulting in a greater pressure drop across orifice 97 than across orifice 95. The pressure in the sensing passage 100 will be higher than the pressure in sensing passage 98. The variable orifice 96 will be restricted to restrict the flow through passage 92. The pitch ram 34 will, thereby, receive fluid at the same rate through conduit 86 as is supplied to pitch ram 42 through conduit 88. The ram 34 and 42 will, therefore, move in unison.

Since the head ends of the rams 34 and 42 are interconnected through the passages internal of valve 80 and the rod ends are interconnected through the conduit 76 and branch conduit 84, an external force may force one ram to extend and the other to contract introducing tilt into the blade. This is precluded by the position of pilot-operated check valve unit 102 in conduits 76 and 88 and a similar unit 104 in conduits 84 and 86. The unit 102 includes check valves 106 and 108 positioned respectively in conduits 88 and 76. Each check valve permits flow toward the ram 42 and is opened by pilot pressure communicated from a positive pressure toward the ram 42 in the other conduit. Hence both valves permit free flow to and from the ram 42, but only when a pressure flow is directed to one of the conduits 76 or 88 from the valve 74. The check valves 110 and 112 of unit 104 are positioned in conduits 86 and 84 respectively, and function to permit free flow of fluid both to and from the pitch arm 34 only upon receiving fluid pressure directed through either one of the conduits 86 and 84 from the valve 74.

The tilt valve 117 is connected with the head end of the tilt ram 44 by a conduit 114 and with the rod end by a conduit 116. Shifting valve 76 to the left, as viewed in FIG. 1, connects the head end of the tilt ram 44 with pump output while connecting its rod end with reservoir by means of conduits 116, 48, 70 and 72. The ram 44 will thereby be extended, raising the left corner of the blade 10. Shifting valve 117 to the right connects the rod end of tilt ram 44 with the pump output and head end with reservoir. The tilt ram 44 will be contracted causing the left corner of the blade 10 to lower. Since gravity assists such lowering, cavitation may occur. A regeneration is provided by a check valve 120 positioned in a conduit 122 connected between conduits 116 and 70. When cavitation would occur, the pressure in the conduit 116 will drop below the pressure in conduit 70. Under such conditions, the check valve 120 would open to permit the fluid expelled by head end of tilt ram 44 to supplement the volume of fluid being supplied by the pump 60 through conduit 116.

A lift valve 124 is connected with the head end of the lift ram 26 by conduit 126 and with the rod end by conduit 128. Shifting the valve 124 to the left connects the rod end of ram 26 to pump output and the head end to reservoir through conduits 126, 130, 70 and 72. The ram 26 will be contracted and the blade 10 raised. Shifting the valve to the right connects the head end of ram 26 to pump output and the rod end to reservoir causing the blade to lower. Since the entire weight of the blade is assisting this lowering action, a more efficient quick drop or regeneration circuit is desired than is the case with cavitation during tilting. This is provided by a quick drop valve 132 which is positioned in the conduit 128. It is a two position valve operated by differential pressure created by a pressure drop across an orifice 134 internal of the valve. Flow of fluid expelled from the rod end of the ram 26 will shift the valve 132 against the bias of spring 136. If in this shifted condition, the pressure in conduit 128 is higher than in conduit 126, an internal check valve 138 will open permitting flow from conduit 128 into conduit 126 by way of a connecting conduit 140. Preferably, the quick drop valve 132 is attached to the cylinder 28 and the conduits connected with it are kept as short as practical. The regeneration will then be rapid and highly efficient.

While a preferred embodiment of the present invention has been disclosed herein, it is understood that various changes and modifications may be made therein without departing from the spirit and principles of the invention as defined by the scope of the appended claims.

What is claimed is:

1. Apparatus for controlling a dozer blade mounted on a pair of push arms comprising:

a pair of pitch rams connected respectively between said blade and said push arms for parallel actuation;

a diverter-combiner valve having an input port and two output ports in parallel communication respectively with first ends of said rams for assuring equal rates of fluid flow to and from said first ends of said rams, said output ports of said diverter-combiner valve being capable of communicating with each other through said valve;

a pitch control valve having a first outlet communicating with said diverter-combiner valve input port and a second outlet in simultaneous fluid communication with the parallel second ends of said pitch rams and disposed to selectively supply pressure to either outlet while draining fluid from the other outlet; and pilot operated check valves connected between the diverter-combiner valve output ports and said first ends of said rams and between said pitch valve outlet and second ends of said rams and disposed to prevent fluid communication between said first ends of said rams and also between said second ends of said rams in the absence of pressure from said pitch valve;

a tilt ram connected between one of said pitch rams and its push arm; and a tilt valve connected to selectively direct pressure to one end of said tilt ram while simultaneously exhausting fluid from the other end.

2. The invention according to claim 1, and further comprising:

a regenerative check valve arranged to permit fluid exhausted from the other end of said tilt ram during lowering of the adjacent corner of said blade to supplement the flow directed to said one end thereof.

3. The invention according to claims 1 or 3 and further comprising:

a lift ram connected to said blade for raising and lowering thereof; and a lift valve for selectively directing pressure to one end of said lift ram while simultaneously exhausting fluid from the other end thereof.

4. The invention according to claim 3 and further comprising:

a regeneration valve moveable in response to lowering of said blade to a position in which exhausted fluid may supplement flow from said lift valve when the pressure of said exhausted fluid is higher.

* * * * *